US006038743A

United States Patent [19]

Chapman

[11] Patent Number: 6,038,743

[45] Date of Patent: Mar. 21, 2000

[54] WRIST-MOUNTED GARMENT TAG HOLDER

[76] Inventor: Cheryl C. Chapman, 1308 Glenn St., Homestead, Pa. 15120

[21] Appl. No.: 09/130,679

[22] Filed: Aug. 6, 1998

[51] Int. Cl.[7] ..... A44B 21/00

[52] U.S. Cl. ..... 24/3.2; 40/633; 40/665; 24/306; 24/3.12

[58] Field of Search ..... 24/306, 442, 3.12, 24/3.2, 265 H, 343; 40/633, 665, 673; 63/3, 3.1, 7; 224/220, 221, 666, 267; 2/16, 158; 294/25

[56] References Cited

U.S. PATENT DOCUMENTS

| | | | |
|---|---|---|---|
| 136,587 | 3/1873 | Clarke | 24/343 X |
| 228,723 | 6/1880 | Barbier et al. | 63/7 |
| 309,408 | 12/1884 | Scott | 224/267 |
| 530,215 | 12/1894 | Weiss | 224/220 |
| 1,279,073 | 9/1918 | Baake | 224/267 |
| 1,417,996 | 5/1922 | Jackson | 24/3 X |
| 1,463,977 | 8/1923 | Smith | 224/267 |
| 3,809,349 | 5/1974 | Baedke | 224/267 X |
| 4,041,562 | 8/1977 | Nealy | 24/3.2 X |
| 4,879,883 | 11/1989 | Bruner | 63/7 X |
| 4,982,641 | 1/1991 | Duhart | 224/267 X |
| 5,082,156 | 1/1992 | Braun | 224/220 |
| 5,092,018 | 3/1992 | Seron | 24/3.2 X |

*Primary Examiner*—James R. Brittain
*Assistant Examiner*—Robert J. Sandy

[57] ABSTRACT

A wrist-mounted tag holder is provided including a plurality of clothing tags and a wrist mount removably secured on a wrist of a user. A hook is connected to the wrist mount for coupling with the tags.

5 Claims, 2 Drawing Sheets

WRIST-MOUNTED GARMENT TAG HOLDER

BACKGROUND OF THE INVENTION

1. Field of the Invention

The present invention relates to tool holders and more particularly pertains to a new wrist-mounted garment tag holder for maintaining a plurality of clothing tags organized in an easily accessed location.

2. Description of the Prior Art

The use of tool holders is known in the prior art. More specifically, tool holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art tool holders and the like include U.S. Pat. No. 5,082,156; U.S. Pat. No. 3,294,299; U.S. Pat. No. 2,522,719; U.S. Pat. Des. 377,862; U.S. Pat. No. 5,328,205; and U.S. Pat. No. 4,887,584.

In these respects, the wrist-mounted garment tag holder according to the present invention substantially departs from the conventional concepts and designs of the prior art, and in so doing provides an apparatus primarily developed for the purpose of maintaining a plurality of clothing tags organized in an easily accessed location.

SUMMARY OF THE INVENTION

In view of the foregoing disadvantages inherent in the known types of tool holders now present in the prior art, the present invention provides a new wrist-mounted garment tag holder construction wherein the same can be utilized for maintaining a plurality of clothing tags organized in an easily accessed location.

The general purpose of the present invention, which will be described subsequently in greater detail, is to provide a new wristmounted garment tag holder apparatus and method which has many of the advantages of the tool holders mentioned heretofore and many novel features that result in a new wrist-mounted garment tag holder which is not anticipated, rendered obvious, suggested, or even implied by any of the prior art tool holders, either alone or in any combination thereof.

To attain this, the present invention is adapted for use with a plurality of clothing tags each having an eyelet formed in an upper corner thereof. As shown in FIGS. 1 & 2, a flexible band is provided with a planar rectangular configuration. The band has an outer face, an inner face and a periphery defined by a pair of elongated side edges and a pair of short end edges. Such end edges include a first end edge and a second end edge. A first pile fastener is mounted on the outer face of the band adjacent to the first end edge thereof. Associated therewith is second pile fastener mounted on the inner face of the band adjacent to the second end edge thereof. Both of the pile fasteners have a width equal to that of the band and a length equal to about ¼ that of the band. In use, the second pile fastener serves to releasably engage the first pile fastener such that the band encompasses a wrist of a user. Finally, a resilient J-shaped hook is provided with an inboard end mounted to a central extent of the outer face of the band. An outboard end of the hook tapers to a blunt point for receiving the eyelets of the tags. As such, the tags are kept organized in a conveniently accessed location.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wrist-mounted garment tag holder apparatus and method which has many of the advantages of the tool holders mentioned heretofore and many novel features that result in a new wrist-mounted garment tag holder which is not anticipated, rendered obvious, suggested, or even implied by any of the prior art tool holders, either alone or in any combination thereof.

It is another object of the present invention to provide a new wrist-mounted garment tag holder which may be easily and efficiently manufactured and marketed.

It is a further object of the present invention to provide a new wrist-mounted garment tag holder which is of a durable and reliable construction.

An even further object of the present invention is to provide a new wrist-mounted garment tag holder which is susceptible of a low cost of manufacture with regard to both materials and labor, and which accordingly is then susceptible of low prices of sale to the consuming public, thereby making such wrist-mounted garment tag holder economically available to the buying public.

Still yet another object of the present invention is to provide a new wrist-mounted garment tag holder which provides in the apparatuses and methods of the prior art some of the advantages thereof, while simultaneously overcoming some of the disadvantages normally associated therewith.

Still another object of the present invention is to provide a new wrist-mounted garment tag holder for maintaining a plurality of clothing tags organized in an easily accessed location.

Even still another object of the present invention is to provide a new wrist-mounted garment tag holder that includes a wrist mount removably secured on a wrist of a user. A hook is connected to the wrist mount for coupling with a plurality of garment tags.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
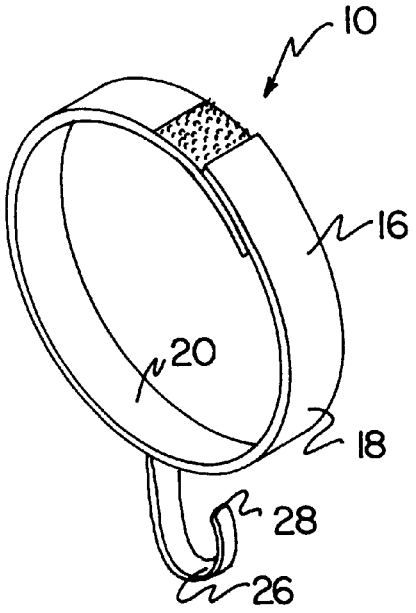
FIG. 1 is a perspective view of a new wrist-mounted garment tag holder according to the present invention.

With reference now to the drawings, and in particular to FIGS. 1 through 4 thereof, a new wrist-mounted garment tag holder embodying the principles and concepts of the present invention and generally designated by the reference numeral 10 will be described.

The present invention, designated as numeral 10, is adapted for use with a plurality of clothing tags 12 each having an eyelet 14 formed in an upper corner thereof.

Figure 2:
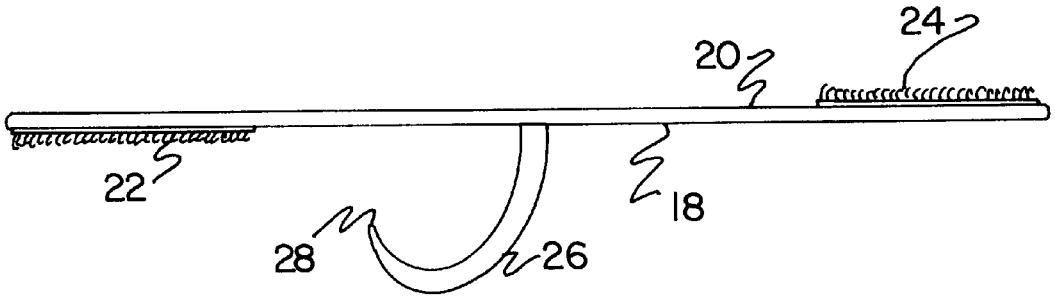
FIG. 2 is a side view of the band of the present invention uncoupled.

As shown in FIGS. 1 & 2, a flexible band 16 is provided with a planar rectangular configuration. The band has an outer face 18, an inner face 20 and a periphery defined by a pair of elongated side edges and a pair of short end edges. Such end edges include a first end edge and a second end edge.

A first pile fastener 22 is mounted on the outer face of the band adjacent to the first end edge thereof. Associated therewith is second pile fastener 24 mounted on the inner face of the band adjacent to the second end edge thereof. Both of the pile fasteners have a width equal to that of the band and a length equal to about ¼ that of the band. In use, the second pile fastener serves to releasably engage the first pile fastener such that the band encompasses a wrist of a user.

Finally, a resilient J-shaped hook 26 is provided with an inboard end mounted to a central extent of the outer face of the band in perpendicular relationship therewith. An outboard end of the hook tapers to a blunt point 28 for receiving the eyelets of the tags. As such, the tags are kept organized in a conveniently accessed location. A length of the hook is preferably 3 inches.

Figure 3:
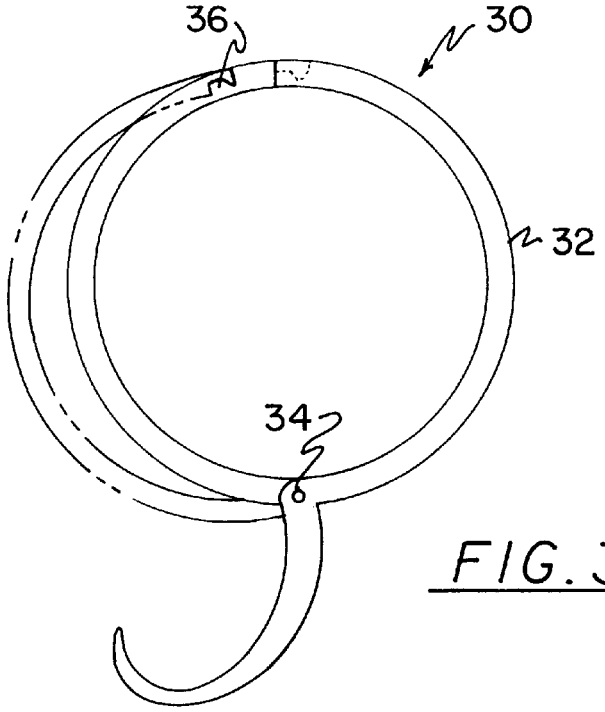
FIG. 3 is a side view of an alternate embodiment of the band of the present invention.
Figure 4:
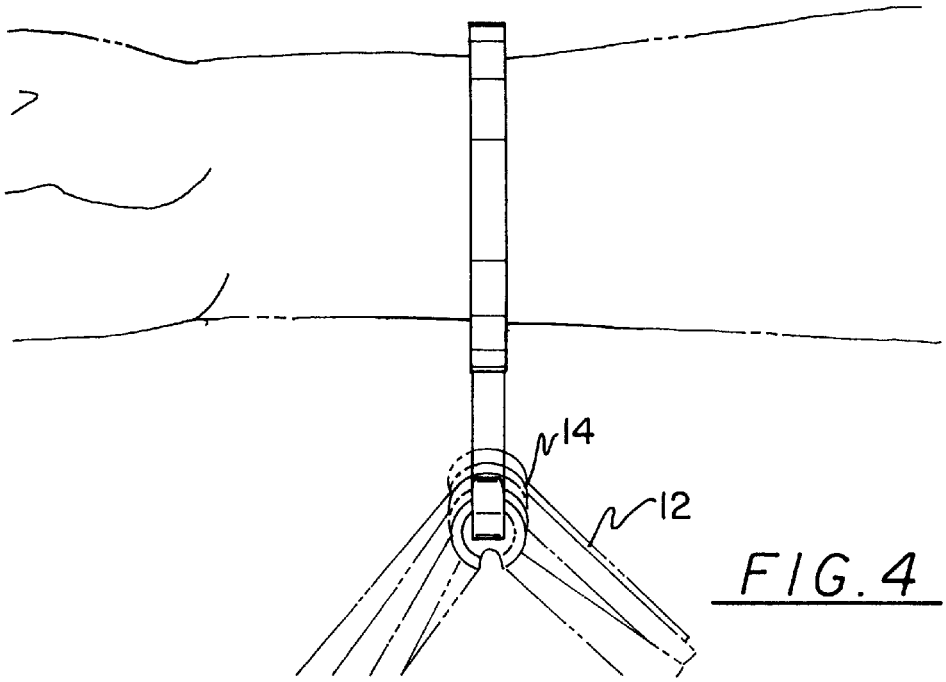
FIG. 4 is a side view of the present invention during use.

An alternate embodiment 30, as shown in FIGS. 3 & 4, will now be set forth. As shown, the wrist-mounted tag holder of the alternate embodiment includes a pair of rigid semi-circular portions 32 which are pivotally coupled with respect to each other via a hinge 34. Ends of the wrist mount of the alternate embodiment are snappily coupled together via a detent/indent combination 36, as shown in FIG. 3. When coupled, such coupling means affords a smooth transition between the semi-circular portions. The inboard end of the hook is preferably integrally coupled to an end of one of the semi-circular portions at the point at which the hinge is formed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrist-mounted tag holder comprising, in combination:

a plurality of clothing tags each having an eyelet formed in an upper corner thereof;

a flexible band with a planar rectangular configuration having an outer face, an inner face and a periphery defined by a pair of elongated side edges and a pair of short end edges including a first end edge and a second end edge;

a first pile fastener mounted on the outer face of the band adjacent to the first end edge thereof, the first pile fastener having a width equal to a width of the band and a length equal to about ¼ a length of the band;

a second pile fastener mounted on the inner face of the band adjacent to the second end edge thereof, the second pile fastener having a width equal to the width of the band and a length equal to about ¼ the length of the band, the second pile fastener being for releasably engaging the first pile fastener such that the band is adapted for fastening around a wrist of a user; and a resilient J-shaped hook with an inboard end mounted to a central extent of the outer face of the band and an outboard end which tapers to a blunt point for receiving the eyelets of the tags.

2. A wrist-mounted object holder comprising:

a wrist mount having an outer face, the wrist mount being adapted to be removably secured on a wrist of a user, wherein the wrist mount includes a pair of rigid arcuate portions which are pivotally coupled with respect to each other; and a resilient J-shaped hook with an inboard end mounted to a central extent of the outer face of the wrist mount and an outboard end which tapers to a blunt point such that the hook is adapted for coupling to objects for facilitating carrying of the objects, said hook having an opening between said outboard end of said hook and said inboard end of said hook such that said hook is adapted for facilitating removal of the objects from said hook by sliding the objects between said outboard and inboard ends;

a first one of said pair of arcuate portions having connection portion having an inwardly facing detent;

a second one of said pair of arcuate portions having a connection portion having an outwardly tracing indent, said indent being complimentary to said detent such that said indent is engaged by said detent whereby said first arcuate portion is couplable to said second arcuate portion; and said hook bring positioned diametrically opposite said detent and said indent when said detent is engaged to said indent such that said indent is adapted to be compressed between said detent and the wrist of the user when said hook is enraged to an object, whereby said detent is prevented from disengaging from said indent.

3. The wrist-mounted object holder as set forth in claim 2 wherein the wrist mount is flexible.

4. The wrist-mounted object holder as set forth in claim 2 wherein ends of the wrist mount are equipped with pile fasteners.

5. The wrist-mounted tag holder as set forth in claim 2 additionally comprising a plurality of clothing tags each having an eyelet formed in an tipper corner thereof.

* * * * *